US005426873A

United States Patent [19]

Savoie

[11] Patent Number: 5,426,873

[45] Date of Patent: Jun. 27, 1995

[54] CLEAT AND PROCESS FOR MAKING SAME

[75] Inventor: Armand J. Savoie, Gardner, Mass.

[73] Assignee: MacNeill Engineering Company, Inc., Marlborough, Mass.

[21] Appl. No.: 343,828

[22] Filed: Nov. 22, 1994

Related U.S. Application Data

[63] Continuation of Ser. No. 4,893, Jan. 19, 1993, abandoned, which is a continuation-in-part of Ser. No. 931,105, Sep. 22, 1992, abandoned, which is a continuation of Ser. No. 560,601, Aug. 1, 1990, abandoned.

[51] Int. Cl.[6] ..... A43B 5/00; A43C 15/02

[52] U.S. Cl. ..... 36/127; 36/67 A; 12/142 R

[58] Field of Search ..... 36/59 B, 67 R, 67 A, 36/67 B, 67 C; 12/142 P, 127, 59 R

[56] References Cited

U.S. PATENT DOCUMENTS

| | | | |
|---|---|---|---|
| 3,327,412 | 6/1967 | Wilmanns | 12/142 P |
| 3,331,148 | 7/1967 | Hollister et al. | 36/67 A |
| 3,492,744 | 2/1970 | Bernier et al. | 36/59 |
| 3,552,043 | 1/1971 | Moffa | 36/67 |
| 3,597,863 | 8/1971 | Austin | 36/127 |
| 3,739,499 | 6/1973 | Morin | 36/127 |
| 3,766,670 | 10/1973 | Nakajima | 36/67 B |
| 3,828,364 | 8/1974 | Aoyama | 36/67 B |
| 3,977,097 | 8/1976 | Ueda | 36/67 D |
| 4,063,372 | 12/1977 | MacNeill | 36/127 |
| 4,561,197 | 12/1985 | Misevich | 36/67 A X |
| 4,587,748 | 5/1986 | Collins | 36/134 |
| 4,667,422 | 5/1987 | Yamaguchi | 36/67 A |
| 4,712,318 | 12/1987 | Greiner et al. | 36/134 |
| 4,723,366 | 2/1988 | Hagger | 36/134 |
| 4,833,796 | 5/1989 | Flemming | 36/134 |
| 4,962,596 | 10/1990 | Dufour | 36/67 A X |

FOREIGN PATENT DOCUMENTS

| | | | |
|---|---|---|---|
| 3541897 | 1/1987 | Germany . | |
| 0176911 | 9/1935 | Switzerland | 36/67 A |
| 1277684 | 4/1971 | United Kingdom . | |
| 1473967 | 5/1977 | United Kingdom . | |

*Primary Examiner*—Bryon P. Gehman
*Assistant Examiner*—Ted Kavanaugh
*Attorney, Agent, or Firm*—Bromberg & Sunstein

[57] ABSTRACT

A process is provided for making a cleat. The cleat includes a spike member, having a tip and a base, the base being wider than the tip. The cleat also includes a washer member, having a perimeter portion and an inner portion, the perimeter and inner portions lying in separate planes. The inner portion has an aperture. The spike member is inserted through the aperture, so that spike member projects out from the lower face of the inner portion. Then material is molded around the washer member's perimeter portion, the upper face of the inner portion, and the base of the spike member, so as to hold the spike member in fixed relation to the washer member. In a preferred embodiment of the process, a barrier is placed around the lower face of the washer member's inner portion during molding, so as to prevent the material from coming into contact with the lower face of the washer member's inner portion and that portion of the spike member extending from the lower face. Preferably, the spike member is made from a wear-resistant material, such as steel, hard metal alloys, ceramic, ceramic-metal compounds, tungsten carbide or titanium carbide. The material molded around the washer member is preferably a thermoplastic. The completed cleat assembly can be molded into the sole of a shoe so that the spike member projects from the sole.

21 Claims, 2 Drawing Sheets

CLEAT AND PROCESS FOR MAKING SAME

DESCRIPTION

This is a continuation of application Ser. No. 08/004,893 filed on Jan. 19, 1993 now abandoned which is a continuation in part of U.S. application Ser. No. 07/931,105, filed Sep. 22, 1992 now abandoned, which is a file-wrapper continuation of Ser. No. 07/560,601, filed Aug. 1, 1990 now abandoned. These applications are hereby incorporated herein by reference.

TECHNICAL FIELD

This invention generally relates to cleats and methods for manufacturing cleats, particularly golf cleats.

SUMMARY OF INVENTION

The invention is directed to a process for making a cleat and the cleat formed by such a process. The cleat includes a spike member, having a tip and a base, the base being wider than the tip. The base preferably has a circumferential lip, so that the base is wider than the shaft of the spike member. The cleat also includes a washer member, having a perimeter portion and an inner portion. The perimeter and inner portions preferably lie in separate planes. The inner portion has an aperture. The inner and perimeter portions each have an upper face and a lower face. The spike member is inserted through the aperture, so that spike member projects out from the lower face of the inner portion, and, in a preferred embodiment, so that the lip of the spike member rests against the upper face of the inner portion. Then material is molded, preferably injection molded, around the upper and lower faces of the washer member's perimeter portion, the upper face of the inner portion, and the base of the spike member, so as to hold the spike member in fixed relation to the washer member. In a preferred embodiment of the process, a barrier is placed around the lower face of the washer member's inner portion during molding, so as to prevent the material from coming into contact with the lower face of the washer member's inner portion and that portion of the spike member extending from the lower face. Preferably, the spike member is made from a wear-resistant material, such as steel, hard metal alloys, ceramic, cer-met materials (i.e., ceramic-metal compounds), tungsten carbide or titanium carbide. The material molded around the washer member is preferably a rigid injection-molded thermoplastic, such as reinforced nylon, or alternatively a die-cast metal. The completed cleat assembly can be molded into the sole of a shoe so that the spike member projects from the sole.

DESCRIPTION OF A SPECIFIC EMBODIMENT

Figure 1:
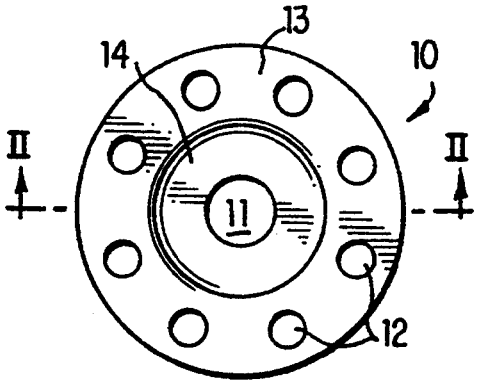
FIG. 1 shows a top plan view of a washer member.
Figure 2:
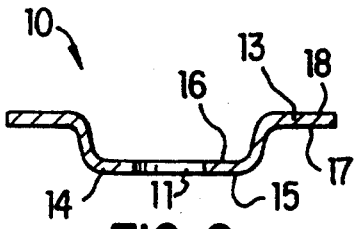
FIG. 2 shows a cross-section through plane II—II of the washer member shown in FIG. 1.

FIGS. 1 and 2 show respectively a top plan view and a cross-section of a washer member 10 that is used in making a cleat according to the present invention. The washer member 10 has an inner portion 14 and a perimeter portion 13, which, as can be seen in FIG. 2, is located on a higher plane than the inner portion 14. The inner portion 14 has a central aperture 11, and the perimeter portion 13 has a plurality of perimeter apertures 12. The inner portion 14 has an upper face 16 and a lower face 15, and the perimeter portion 13 also has an upper face 18 and a lower face 17. The washer member may be made of carbon steel, stainless steel, aluminum, a titanium alloy, or other material.

Figure 3:
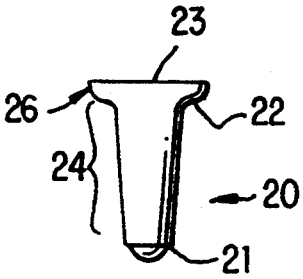
FIG. 3 shows a side view of a spike member.

A spike member 20, which is shown in FIG. 3, can be inserted through the central aperture 11 of the washer member 10. The spike member 20 has a tip 21 at its lower end and a lip 22 around the circumference of its base 26 (i.e., its top face). The spike member's base 26 has a larger diameter than the washer member's central aperture 11, so that the spike member 20 cannot pass all the way through the central aperture 11. (The diameter of the spike member's tip 21 must, of course, be less than that of the central aperture 11; otherwise the spike member 20 could not be inserted into the aperture 11 at all.) When inserted through the central aperture 11, a large portion of the spike member's shaft 24 projects from the lower face 15 of the washer member's inner portion 14. The spike member is preferably made of a wear-resistant material, in particular a ceramic, a carbide or a cer-met material, as noted above.

Figure 4:
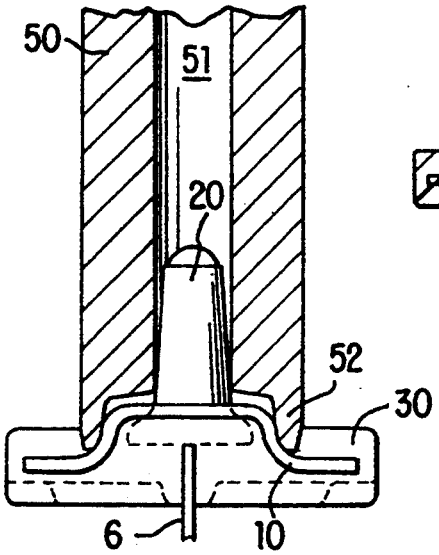
FIG. 4 shows a barrier being used on a cleat as it is being made.

FIG. 4 shows a barrier 50 that may be used when a thermoplastic material 30 is injection molded around the washer member's perimeter portion 13. As an alternative to injection molding the material 30, a metal or other material may be die cast around the perimeter portion 13. The barrier 50 has an inner cannula 51, into which the projecting portion 24 of the spike member 20 may protrude. The barrier 50 helps hold the spike member 20 in its proper position during the injection molding step. The barrier 50 also has a circumferential wall 52, which prevents the thermoplastic 30 from flowing onto the lower face 15 of the washer member's inner portion 14. Also helping to keep the spike member 20 in place with respect to the washer member 10 during molding, is a finger 6, which is pressed against the top face 23 of the spike member 20. During injection molding, the thermoplastic comes into contact with the perimeter portion's upper and lower faces 17 and 18, a portion of the inner portion's upper face 16, and the spike member's top face 23. When the thermoplastic 30 hardens, the spike member 20 is kept rigidly in the desired position with respect to the washer member 10. Preferably a hard thermoplastic, such as reinforced nylon, is used to prevent the spike member 20 from moving too much when subjected to side stresses. TPU 40% glass-filled polyurethane by Dow Chemical has been used with good results.

Figure 5:
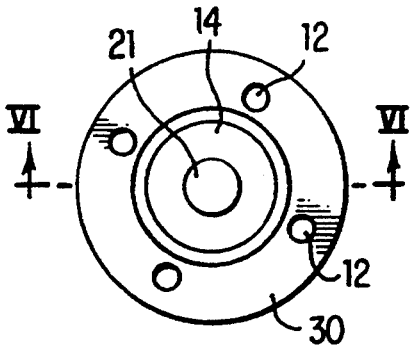
FIG. 5 shows a bottom plan view of the assembled cleat.
Figure 6:
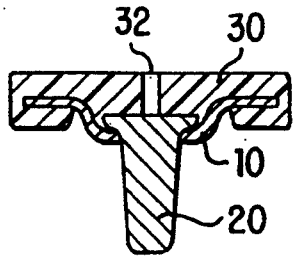
FIG. 6 shows a cross-section through plane VI—VI of the assembled cleat shown in FIG. 5.
Figure 7:
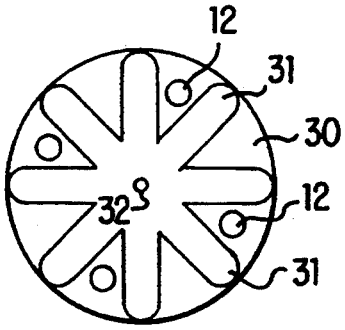
FIG. 7 shows a top plan view of the cleat shown in FIGS. 5 and 6.

FIGS. 5–7 show respectively a bottom plan view, a cross-section and a top plan view of the assembled cleat. As can be seen in FIG. 5, the thermoplastic material 30 has filled four of the eight perimeter apertures 12; this provides a stronger connection between the washer member 10 and the thermoplastic 30 than if perimeter apertures were not present in the washer member 10 or if none of them was filled with the thermoplastic material 30. Four of the perimeter apertures 12—the four that are still visible in FIG. 5—are not filled with the thermoplastic material 30. These apertures 12 help provide a stronger connection between the cleat assembly and the sole material when the cleat assembly is molded into the sole. These apertures 12 are kept free of thermoplastic material 30 by means of additional fingers which protrude through them during molding; these additional fingers help to steady the washer member 10 during molding.

In FIGS. 6 and 7 the hole 32 that the finger 6 formed during the injection molding is visible. Radial ridges 31 on the top of the cleat assembly are visible in FIG. 7. These ridges 31 act as stiffening ribs, increase the cleat assembly's strength and provide resistance to twisting after the cleat assembly is molded into the sole 4.

Figure 8:
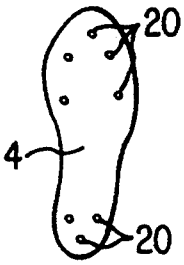
FIG. 8 shows the bottom of a shoe sole having spikes.
Figure 9:
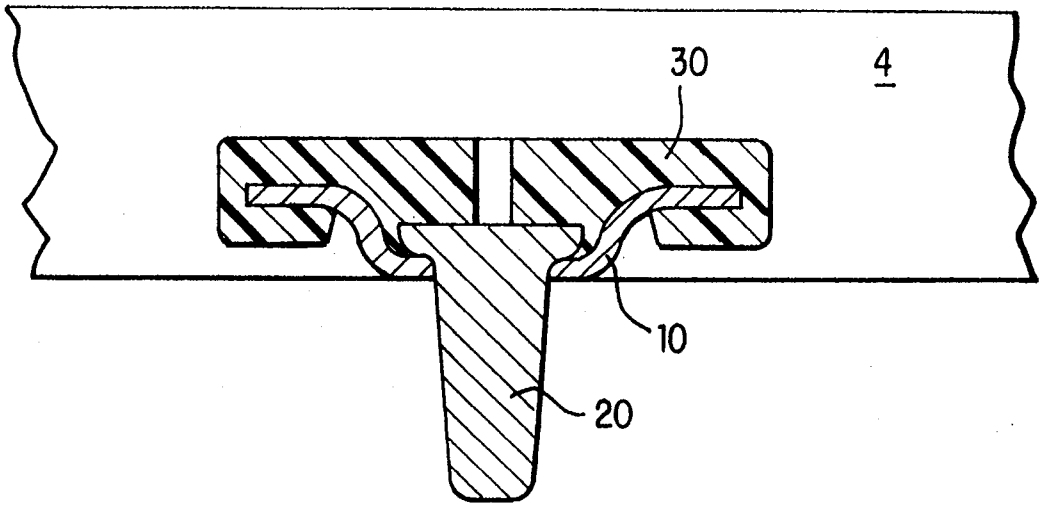
FIG. 9 shows a cross-section of the FIG. 6 cleat assembly molded into a shoe sole.

FIG. 8 shows a bottom plan view of a sole 4 that has eight of the cleat assemblies of the type shown in FIGS. 5-7 molded therein. Although as many as twelve cleat assemblies are used in a typical sole, any number may be used. The only portion of the cleat assemblies visible is the projecting portions 24 of the spike members 20, and a portion of the washer's lower face 15. The cleat assembly is permanently molded into the outsole of the shoe and is meant to last the life of the shoe. FIG. 9 shows a cross-section of one of the cleat assemblies molded into the sole 4.

This process permits a rigid thermoplastic to be used in the cleat assembly, while a more flexible thermoplastic is used in the outsole of the shoe. It is not practical to use a rigid thermoplastic for the entire outsole of the shoe, since the sole of a shoe needs some flexibility in order to permit the wearer to bend his or her toes, nor is it practical to use a flexible thermoplastic to bind together the spike member 20 and the washer member 10, since to do so would permit the spike member 20 to move upward into the bottom of the wearer's foot when weight is placed on the shoe. Thus, using a rigid thermoplastic to bind together the components of the cleat assembly and a more flexible material for the rest of the outsole provides a comfortable and practical cleated shoe.

The present invention provides a durable and simple-to-manufacture cleat assembly. The cleat assembly can withstand impacts, including side impacts, without the benefit of the sole material. There is no mechanical assembly or welding of the cleat parts—other than the simple insertion of the spike member 20 into the washer member 10—prior to molding. Since some wear-resistant materials that are preferred for the spike member 20—in particular, ceramic and ceramic-metal compounds—are difficult to mechanically attach or weld to other components of the cleat, the employment of simple injection molding to maintain the cleat components in rigid relation to each is especially advantageous.

Although the invention has been described with reference to its presently preferred embodiment, it will be understood by one of ordinary skill in the art that various modifications can be made without departing from the spirit and the scope of the invention, as set forth in the claims hereinbelow.

What is claimed is:

1. A process for making a cleat comprising the steps of:

providing a spike member, having a ground-engaging tip end and a base end, the base end being wider than the tip end and having a top face, the top face having a perimeter;

providing a washer member, having a perimeter portion and an inner portion, the inner portion defining an aperture which is smaller than the spike member's base end, the inner and perimeter portions each having an upper face and a lower face;

inserting the spike member through the aperture, so that the tip end of the spike member projects out from the lower face of the inner portion; and molding thermoplastic material around the upper and lower faces of the perimeter portion, the upper face of the inner portion, and the base end of the spike member, so that the thermoplastic material covers a substantial portion of the spike member's top face and is in contact with the perimeter of the spike member's top face, the upper and lower faces of the washer member's perimeter portion add the upper face of the washer member's inner portion, so that the thermoplastic material holds the spike member against the washer member and in fixed relation to the washer member.

2. A process according to claim 1, further including the step of placing a barrier around the lower face of the inner portion during molding, so as to prevent the material from coming into contact with the lower face of the inner portion and that portion of the spike member extending from the lower face.

3. A process according to claim 2, wherein the spike member's base has a circumferential lip, and wherein, when the spike member is inserted through the aperture, the lip of the spike member is placed against the upper face of the inner portion.

4. A process according to claim 1, wherein the spike member's base has a circumferential lip, and wherein, when the spike member is inserted through the aperture, the lip of the spike member is placed against the upper face of the inner portion.

5. A process according to claim 4, wherein the perimeter and inner portions of the washer member lie in separate planes.

6. A process according to claim 1, wherein the perimeter and inner portions of the washer member lie in separate planes.

7. A process for making a spiked shoe sole, comprising the steps of:

providing a spike member, having a ground-engaging tip end and a base end, the base end being wider than the tip end and having a top face, the top face having a perimeter;

providing a washer member, having a perimeter portion and an inner portion, the inner portion defining an aperture which is smaller than the spike member's base end, the inner and perimeter portions each having an upper face and a lower face;

inserting the spike member through the aperture, so that the tip end of the spike member projects out from the lower face of the inner portion;

molding a first thermoplastic material around the upper and lower faces of the perimeter portion, and the base end of the spike member, so as to form a cleat arrangement wherein the first thermoplastic material covers a substantial portion of the spike member's top face and is in contact with the perimeter of the spike member's top face, the upper and lower faces of the washer member's perimeter portion, so that the first thermoplastic material holds the spike member against the washer member and in fixed relation to the washer member; and molding a second thermoplastic material around and in contact with the first thermoplastic material, so as to form the sole of the shoe with the spike member projecting therefrom, wherein the first thermoplastic material is more rigid than the second thermoplastic material.

8. A process according to claim 7, further including the step of placing a barrier around the lower face of the inner portion during molding of the first material, so as to prevent the material from coming into contact with the lower face of inner portion and that portion of the spike member extending from the lower face.

9. A process according to claim 8, wherein the spike member's base has a circumferential lip, and wherein, when the spike member is inserted through the aperture, the lip of the spike member is placed against the upper face of the inner portion.

10. A process according to claim 7, wherein the spike member's base has a circumferential lip, and wherein, when the spike member is inserted through the aperture, the lip of the spike member is placed against the upper face of the inner portion.

11. A process according to claim 10, wherein the perimeter and inner portions of the washer member lie in separate planes.

12. A process according to claim 7, wherein the perimeter and inner portions of the washer member lie in separate planes.

13. A cleat comprising:

a spike member, having a ground-engaging tip end and a base end, the base end being wider than the tip end and having a top face, the top face having a perimeter;

a washer member, having a perimeter portion and an inner portion, the inner portion having an aperture which is smaller than the spike member's base end, the inner and perimeter portions each having an upper face and a lower face, wherein the spike member passes through the aperture, so that the tip end of the spike member projects out from the lower face of the inner portion; and thermoplastic material molded around the upper and lower faces of the perimeter portion, the upper face of the inner portion, and the base end of the spike member, so that the thermoplastic material covers a substantial portion of the spike member's top face and is in contact with the perimeter of the spike member's top face, the upper and lower faces of the washer member's perimeter portion and the upper face of the washer member's inner portion, so that the thermoplastic material holds the spike member against the washer member and in fixed relation to the washer member.

14. A cleat according to claim 13, wherein the material molded around the perimeter portion is a thermoplastic.

15. A cleat according to claim 14, wherein the spike member's base includes a circumferential lip, and the lip rests against the upper face of the inner portion.

16. A cleat according to claim 13, wherein the spike member's base includes a circumferential lip, and the lip rests against the upper face of the inner portion.

17. A cleat according to claim 16, wherein the perimeter and inner portions of the washer member lie in separate planes.

18. A cleat according to claim 13, wherein the perimeter and inner portions of the washer member lie in separate planes.

19. A spiked shoe sole comprising:

a spike member, having a ground-engaging tip end and a base end, the base end being wider than the tip end and having a top face;

a washer member, having a perimeter portion and an inner portion, the inner portion having an aperture which is smaller than the spike member's base end, the inner and perimeter portions each having an upper face and a lower face, wherein the spike member passes through the aperture, so that the tip end of the spike member projects out from the lower face of the inner portion;

a first thermoplastic material molded around the upper and lower faces of the perimeter portion, and the base end of the spike member, so that the thermoplastic material covers a substantial portion of the spike member's top face and is in contact with the perimeter of the spike member's top face, the upper and lower faces of the washer member's perimeter portion, so that the first thermoplastic material holds the spike member against the washer member and in fixed relation to the washer member; and a second thermoplastic material molded around and in contact with the first thermoplastic material, so as to form a sole with the spike member projecting downwardly from the sole, wherein the first thermoplastic material is more rigid than the second thermoplastic material.

20. A sole according to claim 19, wherein the spike member's base includes a circumferential lip, and the lip rests against the upper face of the inner portion.

21. A sole according to claim 19, wherein the first material is more rigid than the second material.

* * * * *